US007621247B2

(12) United States Patent
Iwama et al.

(10) Patent No.: US 7,621,247 B2
(45) Date of Patent: Nov. 24, 2009

(54) DECOMPRESSION APPARATUS AND INTERNAL COMBUSTION ENGINE HAVING THE SAME

(75) Inventors: Toshikazu Iwama, Wako (JP); Kazuyuki Asakura, Wako (JP); Hideyuki Tawara, Wako (JP); Akira Tokito, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 121 days.

(21) Appl. No.: 11/774,901

(22) Filed: Jul. 9, 2007

(65) Prior Publication Data

US 2008/0011257 A1 Jan. 17, 2008

(30) Foreign Application Priority Data

Jul. 14, 2006 (JP) ..... 2006-194896

(51) Int. Cl.
*F01L 13/08* (2006.01)

(52) U.S. Cl. ..... 123/182.1; 123/90.1

(58) Field of Classification Search ..... 123/182.1, 123/90.1, 90.2, 90.6
See application file for complete search history.

(56) References Cited

U.S. PATENT DOCUMENTS 6,250,271 B1 * 6/2001 Ikuma et al. ..... 123/182.1
6,789,521 B2 * 9/2004 Ashida et al. ..... 123/182.1
2002/0157631 A1 * 10/2002 Kawamoto ..... 123/182.1
2006/0048736 A1 * 3/2006 Sugiura et al. ..... 123/182.1
2006/0225686 A1 * 10/2006 Asano et al. ..... 123/182.1

FOREIGN PATENT DOCUMENTS

JP 2006-070831 3/2006

OTHER PUBLICATIONS

"cam." Merriam-Webster Online Dictionary. 2009. Merriam-Webster Online. Jun. 30, 2009 <http://www.merriam-webster.com/dictionary/cam>.*
"locate." Merriam-Webster Online Dictionary. 2009. Merriam-Webster Online. Jun. 29, 2009 <http://www.merriam-webster.com/dictionary/locate>.*

* cited by examiner

*Primary Examiner*—Noah Kamen
(74) *Attorney, Agent, or Firm*—Ditthavong Mori & Steiner, P.C.

(57) ABSTRACT

A decompression apparatus includes a plunger and a decompression shaft. The plunger is provided in a plunger hole formed in a cam shaft which is configured to move an engine valve of an internal combustion engine. The plunger is movable in the plunger hole between a decompression position in which the plunger opens the engine valve and a decompression cancel position in which the plunger does not open the engine valve. The plunger hole has a first opening which partially locates on a cam surface of a valve cam which is provided on the cam shaft. A first end portion of the plunger protrudes from the first opening to open the engine valve in the decompression position. The decompression shaft is provided in the cam shaft and configured to move the plunger between the decompression position and the decompression cancel position.

20 Claims, 5 Drawing Sheets

DECOMPRESSION APPARATUS AND INTERNAL COMBUSTION ENGINE HAVING THE SAME

CROSS-REFERENCE TO RELATED APPLICATIONS

The present application claims priority under 35 U.S.C. §119 to Japanese Patent Application No. 2006-194896, filed Jul. 14, 2006, entitled "DECOMPRESSION APPARATUS FOR INTERNAL COMBUSTION ENGINE." The contents of this application are incorporated herein by reference in their entirety.

BACKGROUND OF THE INVENTION

1. Field of the Invention

The present invention relates to a decompression apparatus and an internal combustion engine having the decompression apparatus.

2. Discussion of the Background

Japanese Unexamined Patent Application Publication No. 2006-70831 discloses a decompression apparatus for an internal combustion engine. The contents of this publication are incorporated herein by reference in their entirety. This decompression apparatus includes a decompression shaft and a plunger. In the decompression shaft, a valve cam for driving an engine valve is provided on a cam shaft. The plunger is accommodated in a plunger hole which is formed in the cam shaft so as to be movable in a radial direction of the cam shaft. The plunger, operated by the decompression shaft, moves between a decompression position and a decompression cancel position in the plunger hole. At the decompression position, the plunger presses the engine valve and opens it. At the decompression cancel position, the engine valve is not opened.

SUMMARY OF THE INVENTION

According to one aspect of the present invention, a decompression apparatus includes a plunger and a decompression shaft. The plunger is provided in a plunger hole formed in a cam shaft which is configured to move an engine valve of an internal combustion engine. The plunger is movable in the plunger hole between a decompression position in which the plunger opens the engine valve and a decompression cancel position in which the plunger does not open the engine valve. The plunger hole has a first opening which partially locates on a cam surface of a valve cam provided on the cam shaft. A first end portion of the plunger protrudes from the first opening to open the engine valve in the decompression position. The decompression shaft is provided in the cam shaft and configured to move the plunger between the decompression position and the decompression cancel position.

According to another aspect of the present invention, an internal combustion engine includes an engine valve, a cam shaft configured to move the engine valve, a valve cam provided on the cam shaft, a plunger and a decompression shaft. The plunger is provided in a plunger hole formed in the cam shaft and is movable in the plunger hole between a decompression position in which the plunger opens the engine valve and a decompression cancel position in which the plunger does not open the engine valve. The plunger hole has a first opening which partially locates on a cam surface of the valve cam. The first end portion of the plunger protrudes from the first opening to open the engine valve in the decompression position. The decompression shaft is provided in the cam shaft and is configured to move the plunger between the decompression position and the decompression cancel position.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 5(A) shows a decompression state, and FIG. 5(B) shows a decompression cancel state.

DESCRIPTION OF THE EMBODIMENTS

Figure 1:
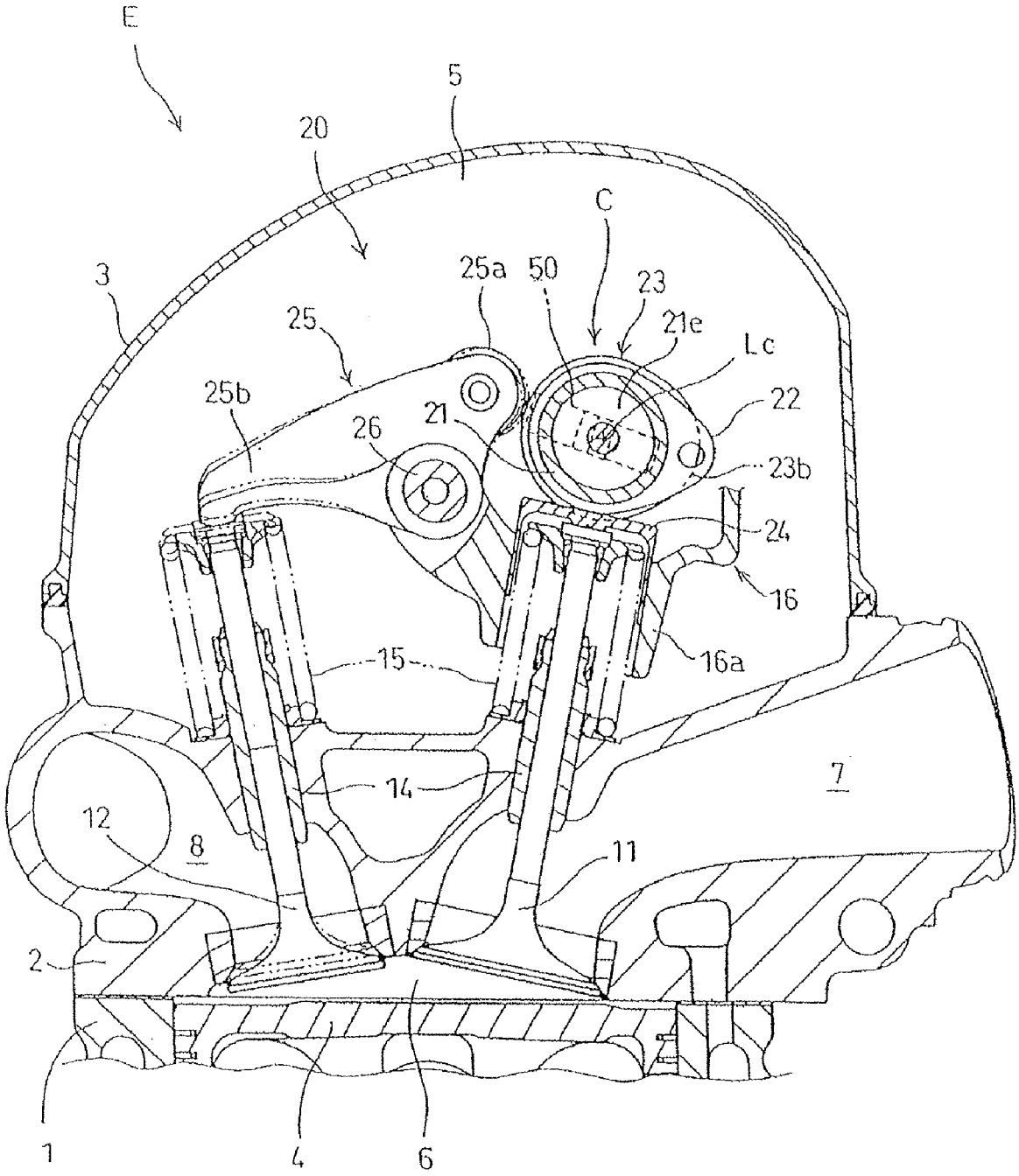
FIG. 1 is a vertical sectional view of a portion of an internal combustion engine including a decompression apparatus according to an embodiment of the present invention, showing the decompression apparatus in a decompression state.

The embodiments will now be described with reference to the accompanying drawings, wherein like reference numerals designate corresponding or identical elements throughout the various drawings.

Figure 2:
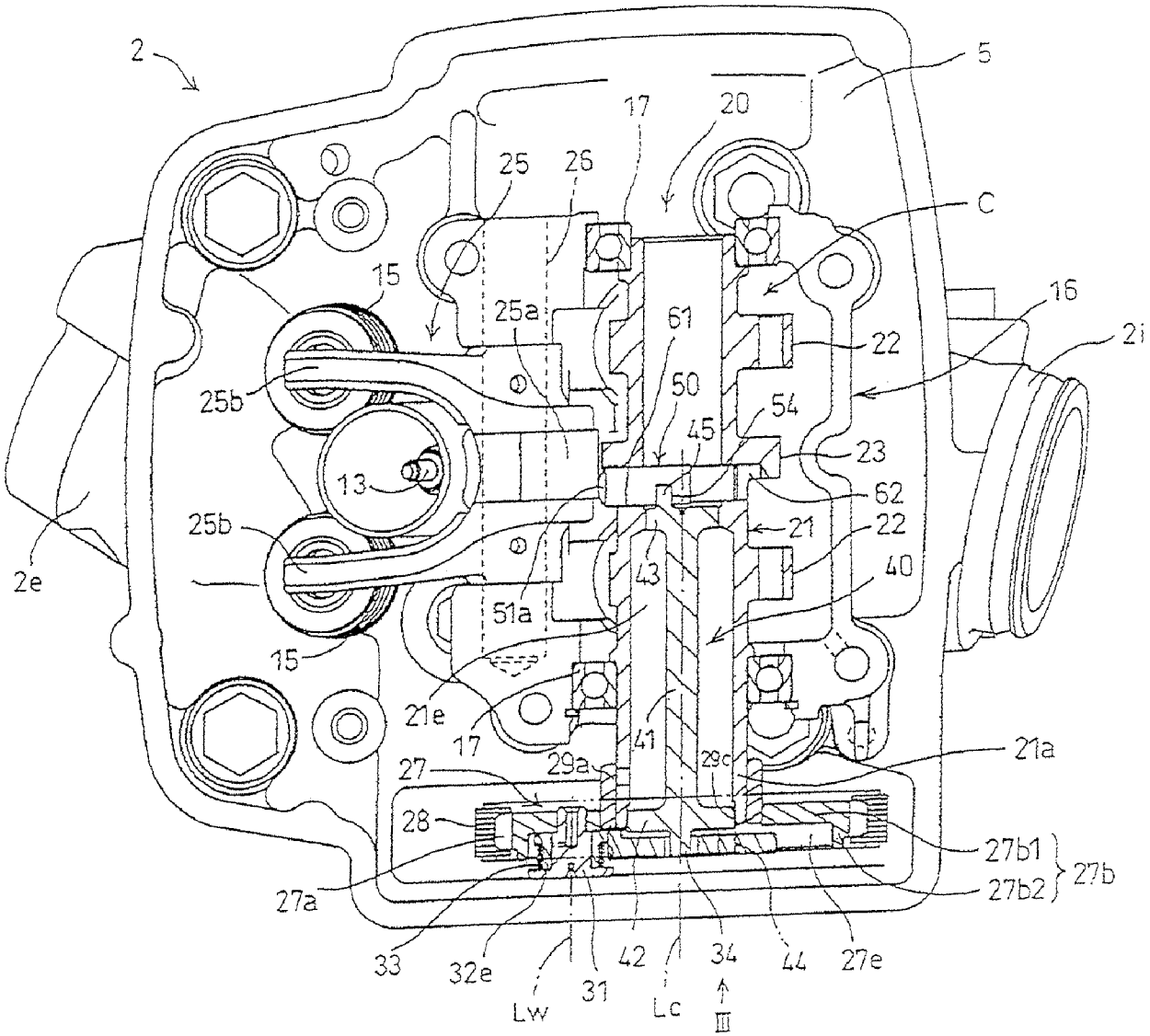
FIG. 2 is a plan view, partly in cross section, of the portion of the internal combustion engine shown in FIG. 1 without a head cover.

Referring to FIGS. 1 and 2, an internal combustion engine E including a decompression apparatus according to an embodiment of the present invention is a single-cylinder reciprocating four-stroke internal combustion engine installed in, for example, a two-wheeled motor vehicle. The internal combustion engine E includes an engine body having a cylinder 1, a cylinder head 2, and a head cover 3. A piston 4 is fitted to the cylinder 1 so that the piston 4 can reciprocate. The cylinder head 2 is joined to an upper end of the cylinder 1. The head cover 3 is joined to an upper end of the cylinder head 2. A valve chamber 5, which accommodates an overhead cam-shaft valve device 20 provided in the internal combustion engine E, is formed by the cylinder head 2 and the head cover 3.

The cylinder head 2 is provided with a combustion chamber 6, provided at a location opposing the piston 4 in an axial direction of a cylinder shaft, an intake port portion 7, which has a pair of intake openings opening to the combustion chamber 6, and an exhaust port portion 8, which has a pair of exhaust openings opening to the combustion chamber 6. Further, the cylinder head 2 is provided with a pair of intake valves 11 and a pair of exhaust valves 12, and an ignition plug 13. The pair of intake valves 11 and the pair of exhaust valves 12 are poppet valves used to open and close both intake openings and both exhaust openings, respectively. The ignition plug 13 faces the central portion of the combustion chamber 6. The exhaust valves 12 and the intake valves 11, which are engine valves, are slidably fitted to valve sleeves 14 press-fitted to the cylinder head 2, and are constantly pressed by elastic force of valve springs 15 to close the engine valves.

Referring to FIG. 2 along with FIG. 1, the valve device 20 includes a cam shaft C, a pair of intake cams 22, one exhaust cam 23, valve lifters 24, and a locker arm 25. The cam shaft C is rotatably supported by a cam holder 16, secured to the cylinder head 2 and the head cover 3 through bolts, through a pair of bearings 17. The pair of intake cams 22 are provided at a shaft body 21 of the cam shaft C. The exhaust cam 23 is disposed between the intake cams 22 in an axial direction of the cam shaft C (this axial direction will hereunder be simply referred to as "the axial direction"). The valve lifters 24 correspond to a pair of cam followers that open and close the pair of intake valves 11 as a result of the valve lifters 24 coming into contact with the pair of intake cams 22. The locker arm 25 corresponds to one cam follower that opens and closes the pair of exhaust valves 12 as a result of the locker arm 25 coming into contact with the pair of exhaust cams 23. Here, the valve lifters 24 and the locker arm 25 are cam contact members which the intake cams 22 for driving the intake valves 11 contact and which the exhaust cam 23 for driving the exhaust valves 12 contacts, respectively.

In the specification, the axial direction is a direction parallel to a rotational center line Lc of the cam shaft C, and a radial direction and a peripheral direction are defined with respect to the rotational center line Lc.

The cam shaft C includes the rotational center line Lc that is parallel to a rotational center line of a crank shaft (not shown) that is rotationally driven by the piston 4 through a connecting rod. The cam shaft C is rotationally driven at ½ the rotational speed of the crank shaft by power of the crank shaft transmitted through a valve transmission mechanism. The valve transmission mechanism includes a driving sprocket, a cam sprocket 27, and a timing chain 28. The driving sprocket is connected to the crank shaft. The cam sprocket 27 is a driven rotating member and is connected to a shaft end 21*a* of the shaft body 21. The timing chain 28 is an endless transmission belt extending between the driving sprocket and the cam sprocket 27.

The exhaust cam 23 includes a base circular portion 23*a*, a cam protruding portion 23*b*, and a cam surface S. The base circular portion 23*a* maintains the exhaust valves 12 in a closed state. The cam protruding portion 23*b* sets the exhaust valves 12 in an open state. The cam surface S is formed over the entire periphery of the exhaust cam 23 so as to extend over the base circular portion 23*a* and the cam protruding portion 23*b*, and slides along a roller 25*a*.

Each valve lifter 24 is slidably supported in a guide cylinder 16*a* integrally formed with the cam holder 16. The locker arm 25, which is slidably supported by a locker shaft 26 held by the cam holder 16, includes the roller 25*a* and a pair of valve pressing portions 25*b*. The roller 25*a* is a cam contact portion which rolls along and contacts the exhaust cam 23. The pair of valve pressing portions 25*b* are formed by a pair of branches divided in two and forming a U shape, and press the exhaust valves 12.

The valve device 20 causes each intake cam 22 to open and close the intake valves 11 through each valve lifter 24 and the exhaust cam 23 to open and close the pair of exhaust valves 12 through the locker arm 25. The opening and closing operations are performed in synchronism with the rotation of the crank shaft, in a predetermined opening/closing period, and by a predetermined lift amount.

Air, sucked through an intake device having an intake pipe mounted to a side 2*i* of the cylinder head 2 having the intake port portion 7 whose inlet opens, mixes with fuel supplied from a fuel supplying device, such as a carburetor, thereby producing an air-fuel mixture. The air-fuel mixture passes through the intake valves 11 opened in an intake stroke, and through the intake port portion 7, and is sucked into the combustion chamber 6. In a compression stroke in which the piston 4 moves upwardly, the air-fuel mixture is compressed. At the end of the compression stroke, the ignition plug 13 ignites the air-fuel mixture, so that the air-fuel mixture burns. Then, the piston 4 driven by pressure of the combustion gas in an expansion stroke in which the piston 4 moves downwardly rotates the crank shaft. Thereafter, the combustion gas passes through the exhaust valves 12 opened in an exhaust stroke in which the piston 4 moves upwardly. Then, after the combustion gas passes through the exhaust port portion 8 from the combustion chamber 6 as exhaust gas, the exhaust gas passes through an exhaust device and is exhausted out of the internal combustion engine E. The exhaust device has an exhaust pipe that is mounted to a side 2*e* of the cylinder head 2 having the exhaust portion 8 whose outlet opens.

Figure 3:
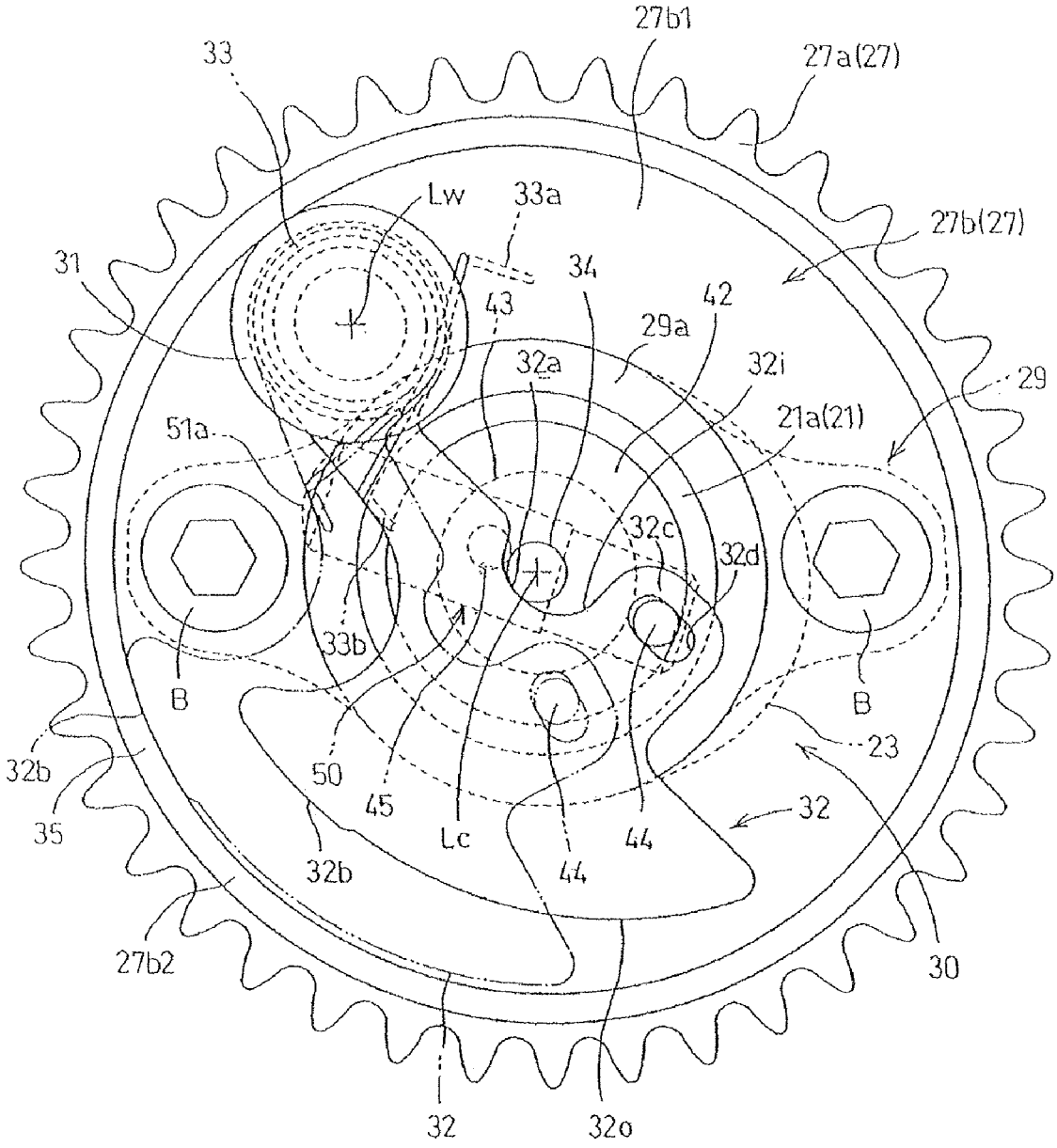
FIG. 3 shows a main portion of the decompression apparatus along an arrow III shown in FIG. 2.

Referring to FIGS. 1 to 3, the decompression apparatus, which reduces load of an electrical starter motor or a manual starting device (such as a kick starting device) serving as a starting device of the internal combustion engine E, is provided at the cam shaft C. The decompression apparatus includes the cam sprocket 27, a driving portion 30, a decompression shaft 40, and a plunger 50. The cam sprocket 27 is a base that is connected to a holder 29, press-fitted to the shaft end 21*a* of the cam shaft C with bolts B, and that rotates with the cam shaft C. The driving portion 30 is provided at the cam sprocket 27. The decompression shaft 40 is an operating member that is movably provided in the cam shaft C and that is driven by the driving portion 30 in accordance with an operation state when the internal combustion engine E is started. The plunger 50 is a decompression element that is provided at the cam shaft C so as to be movable radially, and that is operated by the decompression shaft 40.

The sprocket 27 includes a toothed portion 27*a* and an annular disc portion 27*b*, provided at an inner side of the toothed portion 27*a*. The disc portion 27*b* includes a flat bottom wall 27*b*1 and a cylindrical outer peripheral wall 27*b*2. The bottom wall 27*b*1 has a through hole 29*c* in which the shaft end 21*a* and a boss 29*a* of the holder 29 are inserted. The outer peripheral wall 27*b*2 is situated close to and radially inward with respect to the toothed portion 27*a*, and extends in the axial direction.

The driving portion 30, disposed in a space 27*e* formed as a recess by the bottom wall 27*b*1 and the outer peripheral wall 27*b*2, includes a decompression weight 32, a control spring 33, and a start stopper 34 and an end stopper 35. The decompression weight 32 is pivotally supported by a support shaft 31 secured to a location of the annular disc portion 27*b* that is decentered from the rotational center line Lc. The control spring 33 controls the position of the decompression weight 32 that rotates due to centrifugal force, as a result of causing an elastic force to act upon the decompression weight 32. The start stopper 34 and the end stopper 35 restrict the amount of rotation of the decompression weight 32.

The decompression weight 32, which rotates around a rotational center line Lw, defined by the support shaft 31, as a center, includes a start contact portion 32*a*, an end contact portion 32*b*, and an action portion 32*c*. The start contact portion 32*a* contacts the start stopper 34 that regulates an initial position where the rotation of the decompression weight 32 is started. The end contact portion 32*b* contacts the end stopper 35 that regulates an end position where the rotation of the decompression weight 32 ends. The action portion 32*b* causes driving force of the decompression weight 32 rotating due to centrifugal force to act upon the decompression shaft 40. Substantially the entire decompression weight 32 is accommodated in the space 27.

The start contact portion 32*a* is provided at an inner portion 32*i*, which is a radially inwardly located portion of the decompression weight 32, and has an arc shape with the rotational center line Lc as a center. The end contact portion 32*b* is provided closest to the rotational center line Lw or in the vicinity thereof at an outer side 32*o*, which is a radially outwardly located portion of the decompression weight 33. A hole 32*d* in which an input pin 44 of the decompression shaft 40 is inserted is provided in the action portion 32*c*. Engaging the input pin 44 with the hole 32*d* allows the driving force generated by the driving portion 30 to be transmitted to the decompression shaft 40.

The start stopper 34 is formed by a cylindrical protrusion provided coaxially with the cam shaft C at the decompression shaft 40, and protrudes in the axial direction with respect to the bottom wall 27*b*1. The end stopper 35 is formed by a portion of the outer peripheral wall 27*b*2.

The control spring 33, which as a torsional coil spring, is disposed so as to surround a boss 32*e* of the decompression weight 32 slidably fitted to the outer periphery of the support shaft 31, and is supported by the boss 32*e*. A first end portion 33*a* of the control spring 33 is stopped by the bottom wall 27*b*1, and a second end portion 33*b* thereof is stopped by the decompression weight 32.

When the internal combustion engine E is not running, or when the engine rotational speed is less than a predetermined rotational speed which corresponds to an engine rotational speed when the internal combustion engine is no longer in a cranking state as illustrated by a solid line in FIG. 3, the decompression weight 32 is pressed by the control spring 33, and is brought into contact with the start stopper 34. When the engine rotational speed exceeds the predetermined rotational speed as illustrated by a two-dot chain line, the decompression weight 32 opposes the elastic force of the control spring 33, separates from the start stopper 34, and rotates, so that the end contact portion 32*b* comes into contact with the end stopper 35, and takes the end position.

Referring to FIGS. 1 and 2, the decompression shaft 40 is rotatably supported by the shaft body 21 and provided in the hollow cam shaft C that opens at both ends thereof. The decompression shaft 40, disposed in the hollow portion 21*e* which is a cylindrical space formed coaxially with the shaft body 21, is positioned in the axial direction between the cam sprocket 27 and the plunger 50 which is disposed between one of the intake cams 22 and the exhaust cam 23. The decompression shaft 40 is a single member including a shaft portion 41, a base 42, an end portion 43, the start stopper 34, the input pin 44, and an output pin 45. The shaft portion 41 is a transmission portion extending parallel to the rotational center line Lc. The base 42, which is an input portion, and the end portion 43, which is an output portion, are provided at respective ends of the shaft portion 41. The start stopper 34 is provided at the base 42. The input pin 44 is a protruding pin which is an input end provided at the base 42 to which driving force is input from the driving portion 30. The output pin 45 is a protruding pin which is an operating-side engaging portion provided at the end portion 43. The operating-side engaging portion is an operating portion that operates the plunger 50.

The circular base 42 is slidably fitted to the inner side of the shaft end 21*a* at a location that is adjacent to the decompression weight 32 in the axial direction, and serves as one of journal portions rotatably supported at the shaft end 21*a*. The circular end portion 43 is slidably fitted to a bearing portion 21*b*, provided at the inner side of the shaft body 21, at a location that is axially situated towards the driving portion 30 and adjacent to the plunger 50. The circular end portion 43 serves as the other journal portion rotatably supported at the bearing portion 21*b*. The bearing portion 21*b* is an annular portion that is positioned between the intake cams 22 and the exhaust cam 23 in the axial direction, and that protrudes radially inward.

Referring to FIG. 3 along with FIGS. 1 and 2, the outside diameter of the base 42 is greater than that of the end portion 43, and, while the input pin 44 is situated at the outer periphery of the base 42, the output pin 45 is situated at the end portion 43 so as to be closer to the rotational center line Lc than the input pin 44. Therefore, at the base 42, it is possible to make maximum use of the size of the base 42 to increase driving torque that acts upon the decompression shaft 40 on the basis of the driving force from the decompression weight 32 acting upon the input pin 44. Then, the driving torque transmitted to the end portion 43 through the shaft portion 41 allows an operating force that is greater than the driving force acting upon the input pin 44 to be obtained at the output pin 45 that is closer to the rotational center line Lc than the input pin 44, so that the plunger 50 is operated by the operating force and moves radially. Accordingly, the base 42, the end portion 43, the input pin 44, and the output pin 45 constitute an amplifying mechanism that sets the operating force, used to operate the plunger 50, greater than the driving force, made to act upon the input pin 44 by the action portion 32*c* of the decompression weight 32.

Figure 4A:
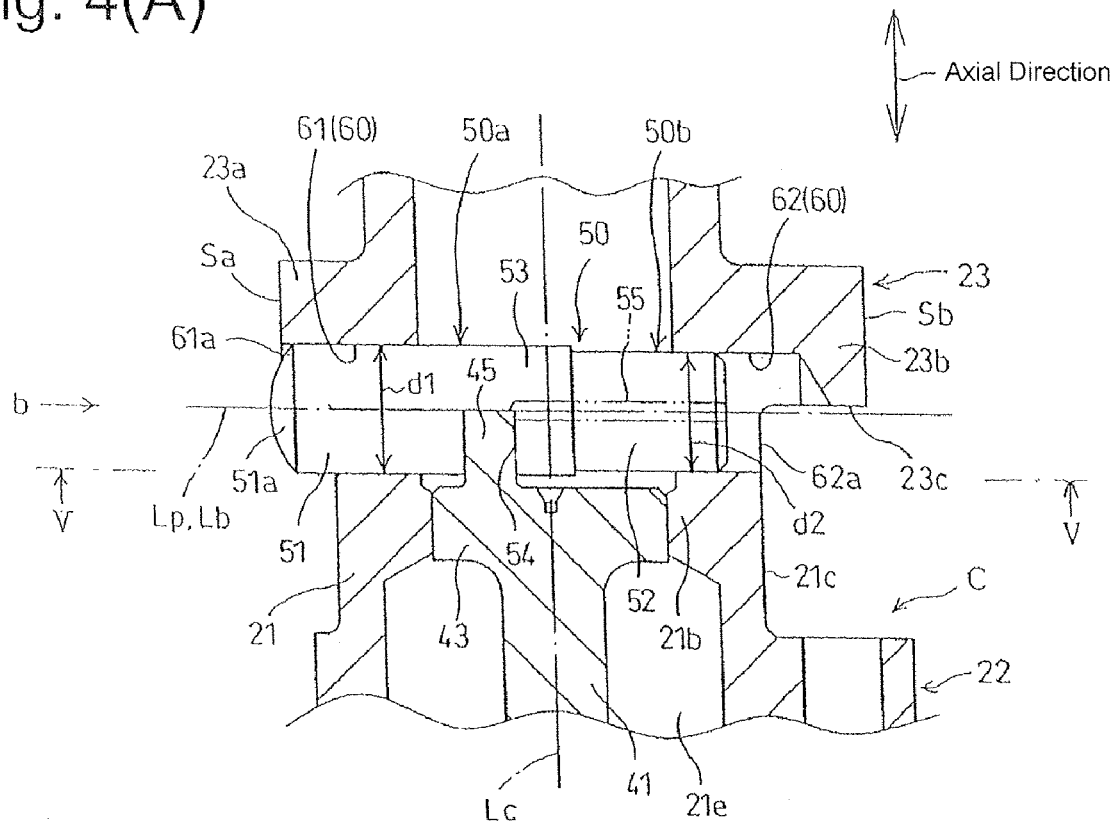
FIG. 4(A) is an enlarged view of the vicinity of a plunger shown in FIG. 2.
Figure 4B:
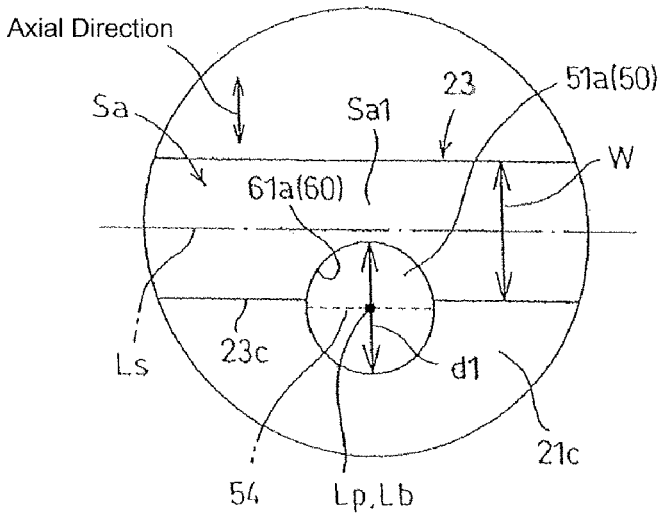
FIG. 4(B) illustrates a main portion along an arrow b shown in FIG. 4(A)
Figure 5A:
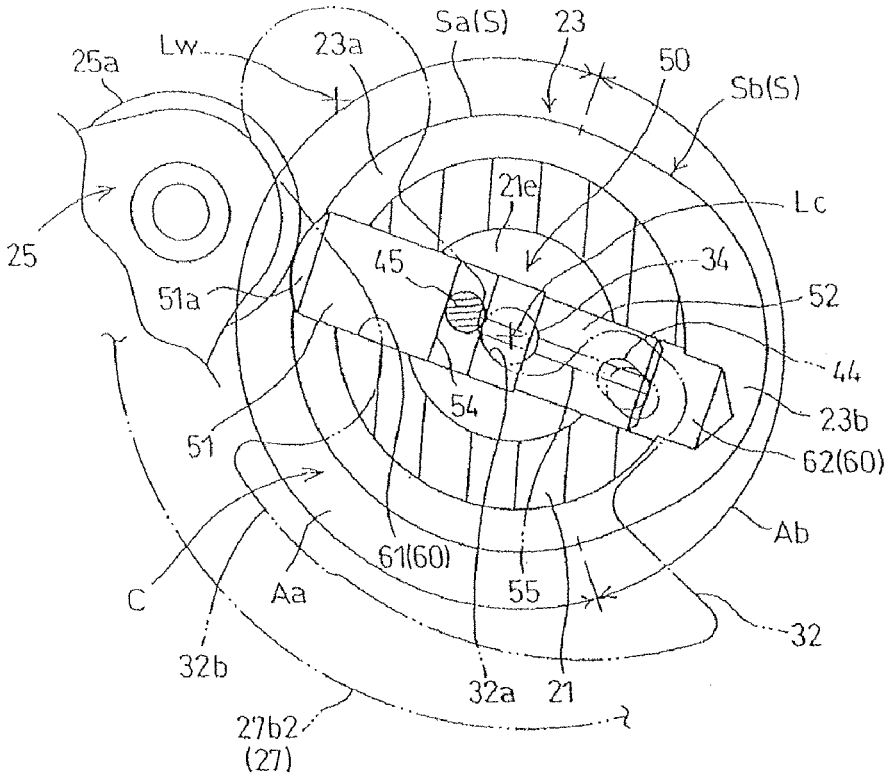
FIGS. 5(A) and 5(B) show an operation of the decompression apparatus, and is centered around the sectional view of FIG. 4(A) taken along a line V-V.

Referring to FIGS. 2, 4, and 5(A), the plunger 50 is radially movably and slidably accommodated in a plunger hole 60 serving as an accommodation space provided in the axial direction between the bearing portion 21*b* and the exhaust cam 23.

The plunger hole 60 is a columnar hole including a center axial line Lb intersecting the rotational center line Lc. In the embodiment, the plunger hole 60 is a cylindrical hole. The plunger hole 60 is formed by drilling in a diametrical direction of the cam shaft C from a range Aa in which the base circular portion 23*a* of the exhaust cam 23 is formed in the peripheral direction (hereunder referred to as "base circular-portion formation range") to a range Ab in which the cam protruding portion 23*b* of the exhaust cam 23 is formed in the peripheral direction (hereunder referred to as "cam protruding-portion formation range"). Accordingly, the plunger hole 60 includes a first hole portion 61 and a second hole portion 62 in the peripheral direction. The first hole portion 61 is positioned in correspondence with the base circular-portion formation range Aa, and the second hole portion 62 is positioned in correspondence with the cam protruding-portion formation range Ab. In addition, in the axial direction, the plunger hole 60 is provided in a range extending from the vicinity of the bearing portion 21*b* to a location where it overlaps a portion of the exhaust cam 23.

Further, the plunger hole 60 includes a first opening 61*a* and a second opening 62*a*. At a location where the plunger hole 60 overlaps a portion of a cam surface Sa of the base circular portion 23*a*, the first opening 61*a* opens at the cam surface Sa, a side surface 23*c* of the exhaust cam 23 and an outer peripheral surface 21*c* of the shaft body 21. On the opposite side of the first opening 61*a* with the rotational center line Lc being positioned therebetween, the second opening 62*a* opens at the side surface 23*c* and the outer peripheral surface 21*c*. A diameter d1, which is also an axial width, of the first hole portion 61 is substantially equal to an axial width W of the cam surface Sa. As shown in FIG. 4(B), an axial center (center axial line Lb) of the plunger hole 60 and a center Ls of the cam surface Sa are displaced from each other in the axial direction. Therefore, since a portion of the cam surface Sa (where the first opening 61*a* opens) that is adjacent to the first opening 61*a* in the axial direction is left as a cam surface Sa1, the cam surface Sb is continuously formed over the entire surface of the exhaust cam 23. The diameter d1 of the plunger hole 60 may be greater than the axial width W of the cam surface Sa.

The first hole portion 61 has the first opening 61*a* at the radially outer side, and opens to the hollow portion 21*e* at the radially inner side. The second hole portion 62 has the second opening 62*a* at the radially outer side, and opens to the hollow portion 21*e* at the radially inner side. The diameter d1 of the first hole portion 61 is greater than a diameter d2 of the second hole portion 62. An area of the first hole portion 61 is greater than an area of the second hole portion 62. Here, the areas refer to cross-sectional areas in a plane that is perpendicular to the center axial line Lb, and, in this embodiment, are determined by the diameters d1 and d2.

The plunger 50 is a single member including a first end portion 51, a second end portion 52, an intermediate portion 53, and a recess 54. The first end portion 51 is provided with a pressing portion 51*a* that presses the exhaust valves 12 through the locker arm 25. The second end portion 52 is radially disposed opposite to the first end portion 51. The intermediate portion 53 is situated at a portion between the end portions 51 and 52 and primarily at the hollow portion 21*e*. The recess 54 is an operated-side engaging portion that is an operated portion that receives operating force from the output pin 45. The first end portion 51 is slidably fitted to and accommodated in the first hole portion 61. The second end portion 52 is slidably fitted to and accommodated in the second hole portion 62.

The plunger 50 is a columnar plunger including a large-diameter portion 50*a* and a small-diameter portion 50*b* and a center axial line Lp. In the embodiment, the plunger 50 is a cylindrical, stepped member, and is disposed in the plunger hole 60 so that the center axial line Lp matches the center axial line Lb. A portion of the intermediate portion 53, the recess 54, and the first end portion 51 are provided at the large-diameter portion 50*a*. A remaining portion of the intermediate portion 53 and the second end portion 52 are provided at the small-diameter portion 50*b*.

The plunger 50 advances and retreats in an advancement direction, in which the pressing portion 51*a* is positioned radially outward, and in a retreating direction, in which the pressing portion (a first end portion) 51*a* is positioned radially inward, respectively, as a result of being operated by the decompression shaft 40 through an engagement structure including the output pin 45 and the recess 54. The center of gravity of the plunger 50 is located where the output pin 45 and the recess 54 contact each other by centrifugal force generated by the plunger 50. More specifically, when the plunger 50 occupies a decompression position, where the pressing portion 51*a* is positioned radially outward from the cam surface Sa of the base circular portion 23*a* and opens the exhaust valves 12, and a decompression cancel position, where the pressing portion 51*a* is positioned radially inward from the decompression position and does not open the exhaust valves 12, the plunger 50 is accommodated in the plunger hole 60 so that its center of gravity is positioned closer to the pressing portion 51*a* from the rotational center line Lc. In addition, the center of gravity of the plunger 50 is positioned even closer to the pressing portion 51*a* as a result of forming the first end portion 51 by the large-diameter portion 50*a* and forming the second end portion 52 (provided opposite to the first end portion 51 provided with the pressing portion 51*a* in the direction of the center axial line Lp) by the small-diameter portion 50*b*.

Therefore, the center of gravity of the plunger 50 is situated at a location where centrifugal force that presses the recess 54 against the output pin 45 in the direction of the decompression position (or the advancement direction) is generated at the plunger 50. When the cam shaft C is rotating, the recess 54 is constantly pressed against the output pin 45 by the centrifugal force.

Referring to FIGS. 3 and 5, the operation of the decompression apparatus will be described.

As shown by the solid line in FIG. 3, when the internal combustion engine E is stopped, the decompression weight 32 is at its initial position where the start contact portion 32*a* contacts the start stopper 34 as a result of biasing the decompression weight 32 by the control spring 33, and the plunger 50 is at is decompression position where the pressing portion 51*a* protrudes radially outward than the cam surface Sa. When the crank shaft is set in a cracking state in which it is rotationally driven by the starting device, the cam shaft C is rotationally driven by the crank shaft through the valve transmission mechanism, and the decompression weight 32 rotates together with the cam shaft C. When the engine rotational speed is equal to or less than the set rotational speed, the centrifugal force that is generated at the decompression weight 32 is small, and the decompression weight 32 occupies its initial position.

In this state, during the compression stroke of the internal combustion engine E, as shown in FIG. 5(A), the roller 25*a* of the locker arm 25 contacts the pressing portion 51*a* of the plunger 50, disposed at the decompression position, to drive the locker arm 25, so that the exhaust valves 12 (see FIG. 1), driven by the locker arm 25, are set in a decompression state in which the exhaust valves 12 are opened by a decompression lift amount. By this, during the compression stroke, the compression pressure in the combustion chamber 6 is released, thereby reducing the pressure in the combustion chamber 6.

Figure 5B:
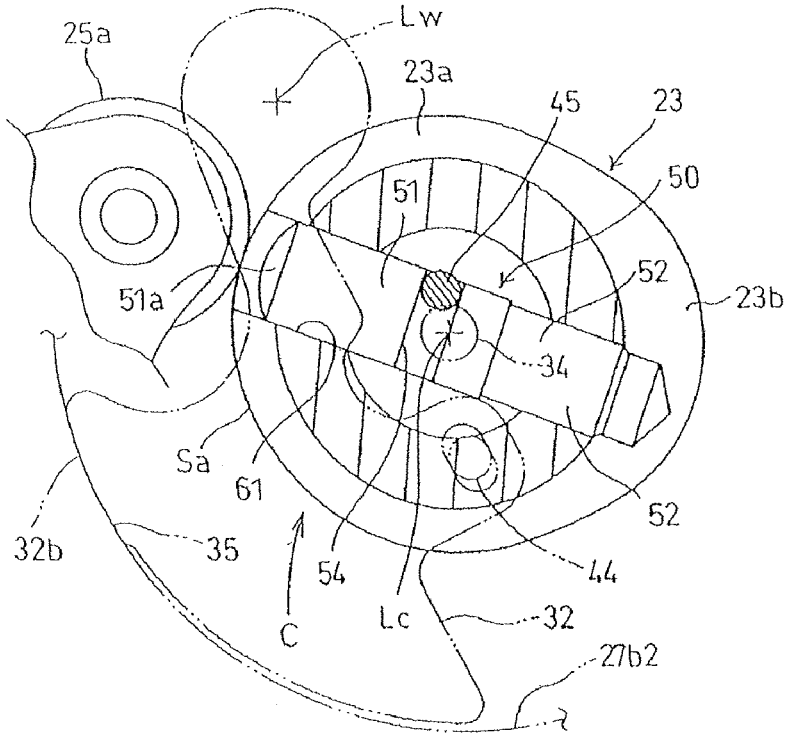

When the engine rotational speed exceeds the set rotational speed, the centrifugal force generated at the decompression weight 32 overcomes the elastic force of the control spring 33, so that the decompression weight 32 rotates clockwise in FIG. 3. In addition, as shown by the two-dot chain line in FIG. 3, the end contact portion 32*b* occupies its end position where the end contact portion 32*b* in contact with the rotation end stopper 35 stops. When the decompression weight 32 moves from the initial position to the end position, the action portion 32*c* causes the driving force to act upon the input pin 44, so that the decompression shaft 40 rotates. By the driving torque transmitted through the shaft portion 41 (refer to FIG. 2), the output pin 45 causes operating force to act upon the recess 54, so that the plunger 50 is moved in the retreat direction. Then, when the decompression weight 32 is at its end position, as shown in FIG. 5(B), the plunger 50 is at the decompression cancel position. In this state, the locker arm 25 is not driven by the plunger 50 during the compression stroke, so that the plunger 50 is set in the decompression cancel state in which the exhaust valves 12 are not opened.

When, after the engine rotation speed is set equal to the set rotational speed, the internal combustion engine E stops due to an operation ending operation of the internal combustion engine E, operations which are the reverse of those mentioned above are carried out, so that the decompression weight 32 occupies the initial position, and the plunger 50 occupies the decompression position.

Accordingly, the decompression weight 32 of the decompression apparatus rotates between the initial position and the end position in accordance with the engine rotational speed. In accordance with this, the plunger 50, which is operated by the decompression shaft 40 that is driven by the driving portion 30, moves radially between the decompression position and the decompression cancel position in the plunger hole 60.

Next, the operations and advantages of the embodiment having the above-described structural features will be described.

The first hole portion 61 of the plunger hole 60, which accommodates the plunger 50 that is operated by the decompression shaft 40, opens at the cam surface Sa at the location where it overlaps a portion of the cam surface Sa of the exhaust cam 23 in the axial direction. An axial width equal to the sum of the axial widths of the exhaust cam 23 and the plunger 50 can be made less than that when the exhaust cam 23 and the plunger 50 do not overlap each other. Therefore, it is possible to restrict an increase in the axial width of the roller 25*a* of the locker arm 25 and an increase in the axial length of the cam shaft C. Moreover, at the portion of the cam surface Sa where the plunger 50 opens, the portion Sa1, which is a portion of the cam surface Sa, is left in the axial direction. Therefore, the cam surface S is continuously formed over the entire periphery. Consequently, a film of lubricating oil that is formed at the cam surface S is not broken, so that good lubricity of the cam surface S is maintained.

The diameter d1, which is an axial width, of the cylindrical plunger hole 60 is greater than or equal to the axial width W of the cam surface Sa, and the axial center of the plunger hole 60 and the axial center of the cam surface Sa are displaced from each other in the axial direction. Therefore, the outside diameter of the plunger 50 can be made large. Consequently, the falling of the plunger 50 resulting from contact with the roller 25*a* can be prevented from occurring. In addition, since the centers of the plunger hole 60 and the cam surface Sa are displaced from each other in the axial direction, it is possible to restrict an increase in the axial width of the roller 25*a* and an increase in the axial length of the cam shaft C, and to maintain good lubricity at the cam surface S of the exhaust cam 23.

The plunger 50 includes the first end portion 51 (provided with the pressing portion 51*a* that presses the exhaust valves 12), and the second end portion 52 (disposed opposite to the first end portion 51 in the radial direction). In the peripheral direction, the first end portion 51 and the second end portion 52 are accommodated, respectively, in the first hole portion 61 and the second hole portion 62 of the plunger hole 60 (provided at the locations corresponding to the base circular-portion formation range Aa and the cam protruding-portion formation range Ab, respectively). In addition, the area of the first hole portion 61 is greater than the area of the second hole portion 62. Accordingly, since the plunger 50 is supported by the first end portion 51 and the second end portion 52, fitted to the first hole portion 61 and the second hole portion 62 of the plunger hole 60, respectively, the plunger 50 is prevented from falling, and is, thus, stably supported by the cam shaft C. Moreover, since the area of the second hole portion 62, provided in the cam protruding-portion formation range Ab, is less than the area of the first hole portion 61, the cam protruding portion 23*b*, which opens the exhaust valves 12, can be easily made rigid. In addition, since the plunger hole 60 is provided near the bearing portion 21*b* protruding radially inward, the plunger 50 is accommodated in a portion whose rigidity is increased by the bearing portion 21*b*. This contributes to increasing the stability with which the plunger 50 is supported.

The plunger 50 is operated radially by the decompression shaft 40 through the engagement structure including the output pin 45, provided at the decompression shaft 40, and the recess 54, provided at the plunger 50. The center of gravity of the plunger 50 is situated at a location where centrifugal force that pushes the recess 54 against the output pin 45 in the direction of the decompression position is generated, so that, by the centrifugal force generated at the plunger 50 rotating with the cam shaft C, the output pin 45 is constantly in contact with the recess 54. Consequently, striking sound, generated when the engaging portions (including the output pin 45 and the recess 54) collide with each other due to vibration of the internal combustion engine or when the plunger shaft 40 moves the plunger 50 to the decompression cancel position and to the decompression position, is reduced. Further, the center of gravity of the plunger 50 is positioned even closer to the pressing portion 51*a* as a result of forming the first end portion 51 by the large-diameter portion 50*a* and forming the second end portion 52 (provided opposite to the first end portion 51, provided with the pressing portion 51*a*, in the direction of the center axial line Lp) by the small-diameter portion 50*b*. Therefore, the effectiveness of reducing the striking sound is increased.

Since the decompression shaft 40 includes an amplifying mechanism that sets the operating force, used to operate the plunger 50, greater than the driving force, a large operating force, used to operate the plunger 50, can be obtained by a small driving force at the driving portion 30. Therefore, it is possible to reduce the size and weight of the driving portion 30 for generating the driving force, to accelerate the movement of the plunger 50 by the large operating force, and to quickly cancel the decompression state. Further, since the amplifying mechanism includes the base 42, the end portion 43, the input pin 44, and the output pin 45, an amplifying mechanism having a simple structure can be provided.

The end contact portion 32*b* is provided closest to the rotational center line Lw or in the vicinity thereof at the outer side of the decompression weight 32, so that the rotational speed of the end contact portion 32*b* is less than that of a portion of the outer portion 32*o* that is further away from the rotational center line Lw than the end contact portion 32*b*. Therefore, sound that is generated when the decompression weight 32 contacts the end stopper 35 is reduced.

Modifications of the above-described embodiment, in which structures of portions of the above-described embodiment are modified, will hereunder be described.

As illustrated by alternate long and two short dashed lines in FIGS. 4(A) and 5(A), an oil path 55 that guides lubricating oil from an end surface of the second end portion 52 to the recess 54 may be provided at the second end portion 52 and the intermediate portion 53 of the plunger 50. When the internal combustion engine E is stopped or is rotating at a low speed, lubricating oil in the valve chamber 5 flows through the oil path 55 and is guided to the contact portion of the output pin 45 and the recess 54.

Accordingly, when the oil path 55 that guides lubricating oil to the recess 54 is provided at the second end portion 52, lubricity of the output pin 45 and the recess 54 is increased, and the second end portion 52 becomes lighter in correspondence with the oil path 55. Therefore, the center of gravity of the plunger 50 is situated even closer to the pressing portion 51*a* of the plunger 50 from the rotational center line Lc of the cam shaft C. This contributes to reducing striking sound at the output pin 45 and the recess 54 while reducing the weight of the plunger 50.

According to the embodiments of the present invention, since the plunger hole, in which the plunger is accommodated, is provided so as to open at the position where the plunger hole overlaps a portion of the surface of the valve cam in the axial direction of the cam shaft, the axial width equal to the sum of the axial widths of the valve cam and the plunger can be made smaller than that when the valve cam and the plunger do not overlap each other. Therefore, it is possible to restrict an increase in the axial width of a cam contact member and an increase in the axial length of the cam shaft. Moreover, since, at the portion of the cam surface where the plunger opens, a portion of the cam surface is left in the axial direction, the cam surface is continuously formed over its entire periphery. Consequently, good lubricity of the cam surface is maintained without breaking a lubricating oil film formed at the cam surface.

According to the embodiments of the present invention, since the outside diameter of the plunger can be made large, falling of the plunger resulting from contact with a cam contact member is prevented from occurring. In addition, since the center is displaced in the axial direction, it is possible to restrict an increase in the axial width of the cam contact member and an increase in the axial length of the cam shaft, and to maintain good lubricity at the surface of the valve cam.

According to the embodiments of the present invention, since the plunger is supported by the first end portion and the second end portion that are fitted to the first and second hole portions of the plunger hole, respectively, the plunger is prevented from falling, and is stably supported by the cam shaft. Moreover, since the diameter of the second hole portion, provided within the cam protruding-portion range in the peripheral direction, is less than that of the first hole portion, it becomes easy to ensure rigidity of the cam protruding portion that opens the engine valve.

According to the embodiments of the present invention, since the operating-side engaging portion is constantly in contact with the operated-side engaging portion due to centrifugal force produced at the plunger rotating with the cam shaft, striking sound, generated when the engaging portions collide with each other due to vibration of the internal combustion engine or when the plunger shaft moves the plunger to the decompression cancel position and to the decompression position, is reduced.

According to the embodiments of the present invention, an oil path is provided to, not only increase lubricity at both engaging portions, but also to reduce the weight of the second end portion in correspondence with the oil path. Therefore, the center of gravity of the plunger is provided even closer to the pressing portion, provided at the first end portion of the plunger, from a rotational center line of the cam shaft. This contributes to reducing striking sound generated between the engaging portions while reducing the weight of the plunger.

According to the embodiments of the present invention, the amplifying mechanism of the decompression shaft allows a large operating force for operating the plunger to be obtained by a small driving force at the driving portion. Therefore, it is possible to reduce the size and weight of the driving portion for generating the driving force, to accelerate the movement of the plunger by a large operating force, and to quickly cancel a decompression state.

The operating-side engaging portion may be formed by a recess, and the operated-side engaging portion may be formed by a protrusion.

Depending upon the structure of the intake valves or the exhaust valves, cam followers need not be provided. In this case, the intake valves and the exhaust valves, themselves, constitute the cam contact members.

The diameter d1 of the plunger hole 60 may be less than the axial width W of the cam surface Sa. Therefore, the first opening 61*a* may open only at the cam surface Sa of the cam shaft C. The second opening 62*a* need not be provided.

A structure in which the decompression shaft is driven by the driving portion in the axial direction, and the operating-side engaging portion and the operated-side engaging portion constitute an engagement structure that converts axial motion of the decompression shaft into radial motion of the plunger may be used.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A decompression apparatus comprising:

a plunger which is provided in a plunger hole formed in a cam shaft configured to move an engine valve of an internal combustion engine and which is movable in the plunger hole between a decompression position in which the plunger opens the engine valve and a decompression cancel position in which the plunger does not open the engine valve, the plunger hole having a first opening which partially overlaps and extends through a cam surface of a valve cam provided on the cam shaft, a first end portion of the plunger protruding from the first opening to open the engine valve in the decompression position; and a decompression shaft which is provided in the cam shaft and which is configured to move the plunger between the decompression position and the decompression cancel position.

2. The decompression apparatus according to claim 1, wherein the plunger is provided in the plunger hole which extends along a radial direction of the cam shaft.

3. The decompression apparatus according to claim 1, wherein the decompression shaft is configured to be moved along a center axis of the decompression shaft to move the plunger between the decompression position and the decompression cancel position.

4. The decompression apparatus according to claim 1, further comprising an amplifying mechanism configured to amplify a force so that an operation force to move the plunger between the decompression position and the decompression cancel position becomes larger than a driving force applied to the decompression shaft.

5. The decompression apparatus according to claim 4, wherein the decompression shaft includes an input engaging portion and an output engaging portion, the driving force is applied to the decompression shaft via the input engaging portion, the operation force is applied to the plunger via the output engaging portion, and the input engaging portion and the output engaging portion are provided such that a distance between the input engaging portion and a center axis of the decompression shaft is larger than a distance between the output engaging portion and the center axis of the decompression shaft.

6. The decompression apparatus according to claim 5, wherein the input engaging portion is provided on a base having a first diameter and the output engaging portion is provided on an end portion having a second diameter, and wherein the first diameter is larger than the second diameter.

7. The decompression apparatus according to claim 1, wherein a length of the plunger hole along an axial direction of the cam shaft is larger than a width of the cam surface along the axial direction of the cam shaft.

8. The decompression apparatus according to claim 1, wherein an axial center of the plunger hole is displaced from a center of the cam surface along the axial direction.

9. The decompression apparatus according to claim 1, wherein a length of the plunger hole along an axial direction of the cam shaft is substantially equal to a width of the cam surface along the axial direction of the cam shaft.

10. The decompression apparatus according to claim 1, wherein the plunger includes a first cylindrical portion and a second cylindrical portion which is connected to the first cylindrical portion concentrically.

11. The decompression apparatus according to claim 10, wherein the first cylindrical portion having a diameter larger than a diameter of the second cylindrical portion.

12. The decompression apparatus according to claim 1, wherein the plunger is provided in the plunger hole which has the first opening and a second opening, the first opening being located on a base circular portion of the cam surface, the second opening being located on a cam protruding portion of the cam surface.

13. The decompression apparatus according to claim 12, wherein the plunger includes a first cylindrical portion and a second cylindrical portion which is connected to the first cylindrical portion concentrically, and wherein the first cylindrical portion having a diameter larger than a diameter of the second cylindrical portion.

14. The decompression apparatus according to claim 1, wherein the plunger has a center of gravity at a position so that the decompression shaft engages with the plunger by applying a centrifugal force to the plunger.

15. The decompression apparatus according to claim 1, wherein the plunger comprises an oil path.

16. The decompression apparatus according to claim 15, wherein the oil path extends along a center axis of the plunger from a second end portion of the plunger opposite to the first end portion of the plunger.

17. The decompression apparatus according to claim 1, wherein a length of the plunger hole along an axial direction of the cam shaft is smaller than a width of the cam surface along the axial direction of the cam shaft.

18. The decompression apparatus according to claim 1, wherein the decompression shaft is configured to move the plunger in a radial direction of the cam shaft.

19. The decompression apparatus according to claim 1, wherein the decompression shaft is configured to be rotated to move the plunger between the decompression position and the decompression cancel position.

20. An internal combustion engine comprising:

an engine valve;

a cam shaft configured to move the engine valve;

a valve cam provided on the cam shaft;

a plunger which is provided in a plunger hole formed in the cam shaft and which is movable in the plunger hole between a decompression position in which the plunger opens the engine valve and a decompression cancel position in which the plunger does not open the engine valve, the plunger hole having a first opening which partially overlaps and extends through a cam surface of the valve cam, a first end portion of the plunger protruding from the first opening to open the engine valve in the decompression position; and a decompression shaft which is provided in the cam shaft and which is configured to move the plunger between the decompression position and the decompression cancel position.

* * * * *